US007961206B2

(12) United States Patent
Ohmiya

(10) Patent No.: US 7,961,206 B2
(45) Date of Patent: Jun. 14, 2011

(54) ATTACHMENT FOR USE IN IMAGE-FORMING APPARATUS TO CONNECT EXTERNAL DEVICE THERETO

(75) Inventor: Takashi Ohmiya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1113 days.

(21) Appl. No.: 11/691,648

(22) Filed: Mar. 27, 2007

(65) Prior Publication Data

US 2007/0229570 A1 Oct. 4, 2007

(30) Foreign Application Priority Data

Mar. 31, 2006 (JP) ..... 2006-098168

(51) Int. Cl.
*B41J 29/13* (2006.01)
*B41J 2/385* (2006.01)
*B41J 2/41* (2006.01)
*B41J 2/435* (2006.01)

(52) U.S. Cl. ..... 347/138; 347/108; 347/152; 347/263

(58) Field of Classification Search ..... 347/138, 347/152, 263

See application file for complete search history.

(56) References Cited

U.S. PATENT DOCUMENTS

2002/0127028 A1* 9/2002 Amano ..... 399/88

FOREIGN PATENT DOCUMENTS

| | | |
|---|---|---|
| JP | 7089190 | 4/1995 |
| JP | 2003077606 | 3/2003 |
| JP | 2003276276 | 9/2003 |
| JP | 3100895 U1 | 1/2004 |
| JP | 2004134469 | 4/2004 |
| JP | 2004230737 | 8/2004 |
| JP | 2005-109584 A | 4/2005 |

OTHER PUBLICATIONS

JP Office Action dtd Jul. 7, 2009, JP Appln. 2006-098168, English translation.

JP Office Action dtd Jan. 19, 2010, JP Appln. 2006-098168, partial English translation.

* cited by examiner

*Primary Examiner* — Matthew Luu
*Assistant Examiner* — Kendrick X Liu
(74) *Attorney, Agent, or Firm* — Banner & Witcoff, Ltd.

(57) ABSTRACT

An apparatus for image formation is disclosed which includes an imaging device forming images on record media; a housing defining a front face, a rear face, both side faces, a top face and a bottom face, to thereby house the imaging device; a recessed portion configured so as to be openable at selected at least one of the front face, the both side faces and the top face of the housing; and an attachment mechanism allowing a data-storable external storage device to be attached to the apparatus for electrical connection thereto, the attachment mechanism being in a position allowing the external storage device, when attached to the attachment mechanism, to be accommodated within the recessed portion.

12 Claims, 11 Drawing Sheets

ATTACHMENT FOR USE IN IMAGE-FORMING APPARATUS TO CONNECT EXTERNAL DEVICE THERETO

CROSS-REFERENCE TO RELATED APPLICATIONS

This application is based on Japanese Patent Application No. 2006-98168 filed Mar. 31, 2006, the content of which is incorporated hereinto by reference.

BACKGROUND OF THE INVENTION

1. Field of the Invention

The invention relates generally to apparatuses for use in image formation, such as printers (e.g., laser printers or inkjet printers), and more particularly to techniques of removably attaching external devices to the apparatuses.

2. Description of the Related Art

In applications where images are formed or printed (e.g., electrophotography such as a laser-type or other-types of printers), it has become popular to provide image-forming apparatuses with sockets (i.e., female connectors) which allows connection with Universal Serial Bus (USB) cables that extend out from personal computers (hereinafter, abbreviated to "PCs").

An example of such image-forming apparatuses is disclosed in Japanese Patent Application Publication No. 2003-276276. This example is configured to incorporate a laser printer having a body casing which is exposed at least at its front face. An interface connector (e.g., a USB port) is disposed, for allowing entry of print data, on the exposed front face of the body casing.

The technique disclosed in the above-mentioned publication would allow a user, when wishing to connect a notebook or laptop PC or the like to the above-described laser printer, to connect a USB cable of the PC to the USB port of the laser printer, by a user quick-and-easy operation on the side of the front face of the body casing.

In view of the foregoing, it would be desirable to provide an image-forming apparatus allowing an external device to be attached to the image-forming apparatus in an optimized position.

BRIEF SUMMARY OF THE INVENTION

According to some aspects of the invention, an apparatus for image formation is provided which includes an imaging device; a housing to house the imaging device; a recessed portion configured so as to be openable at an exposed face of the housing; and an attachment mechanism to allow an external device to be attached to the apparatus. The attachment mechanism is in a position allowing the external device, when attached to the attachment mechanism, to be accommodated within the recessed portion.

It is noted here that, as used in this specification, the singular form "a," "an," and "the" include plural reference unless the context clearly dictates otherwise. It is also noted that the terms "comprising," "including, and having" can be used interchangeably.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

General Overview

Figure 1:
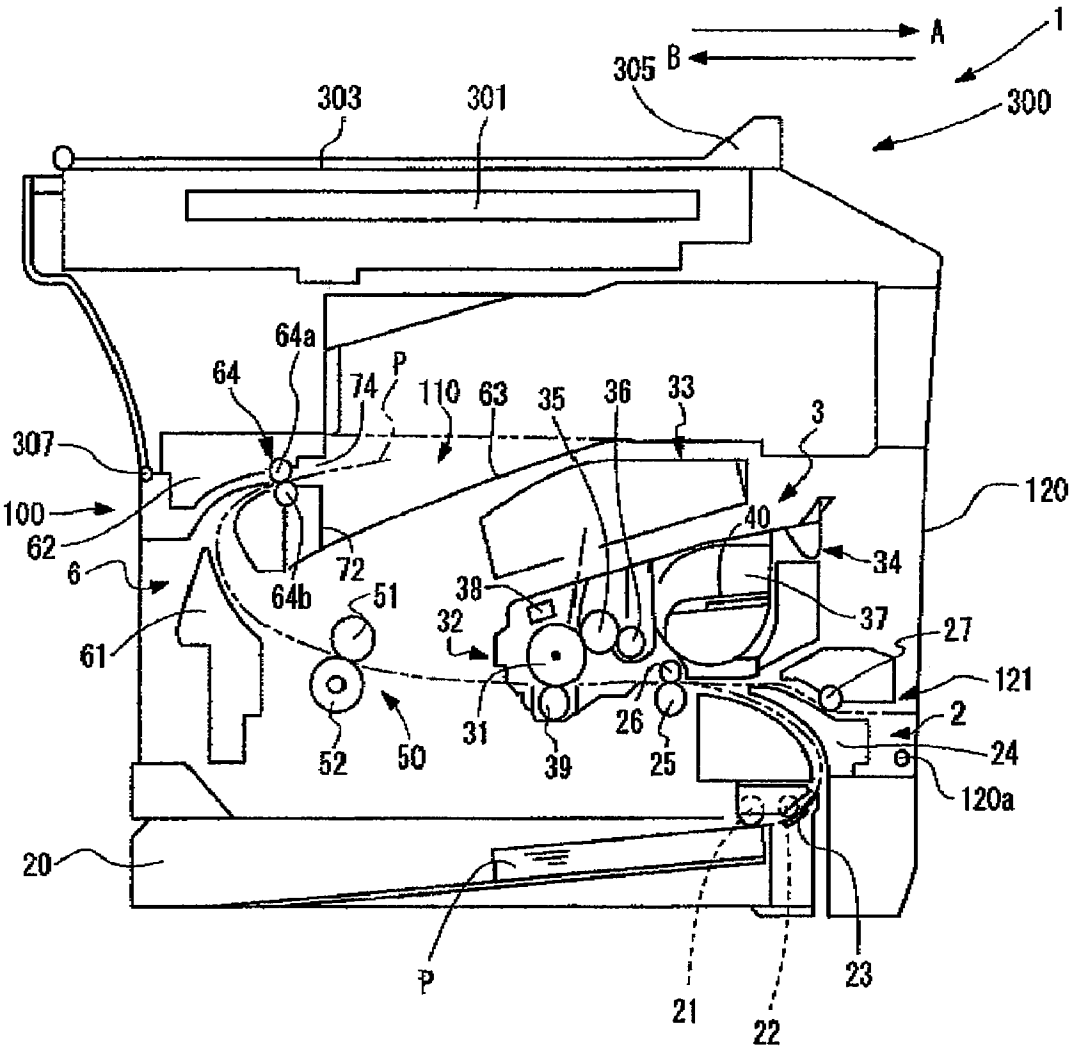
FIG. 1 is a mid-sectional view illustrating a laser printer 1 constructed according to a first illustrative embodiment of the invention, wherein the laser printer 1 is configured to incorporate an image reader 300.

According to a first aspect of the invention, there is provided an apparatus for image formation which includes an imaging device forming images on record media; a housing defining a front face, a rear face, both side faces, a top face and a bottom face, to thereby house the imaging device; a recessed portion configured so as to be openable at selected at least one of the front face, the both side faces and the top face of the housing; and an attachment mechanism allowing a data-storable external storage device to be attached to the apparatus for electrical connection thereto.

The attachment mechanism is in a position allowing the external storage device, when attached to the attachment mechanism, to be accommodated within the recessed portion.

According to a second aspect of the invention, there is provided an apparatus for image formation which includes an imaging device forming images on sheets; a housing that houses the imaging device; a sheet outlet through which the sheets pass to exit the apparatus after image formation by the imaging device; a sheet exit tray formed integrally with the housing to store the sheets after exiting the sheet outlet; and an attachment mechanism allowing a data-storable external storage device to be detachably attached to the apparatus for electrical connection thereto.

The sheet exit tray is configured to have a recessed portion in a position allowing a user to access the recessed portion. The sheet exit tray stores the sheets in stack on the recessed portion.

The attachment mechanism is in a position allowing the user to access the external storage device, when attached to the attachment mechanism at least temporarily. The attachment mechanism allows the external storage device, when attached to the attachment mechanism, to be accommodated within the recessed portion, without interfering with storage of the sheets on the recessed portion.

ILLUSTRATIVE EMBODIMENTS

According to the invention, the following modes are provided as illustrative embodiments of the invention.

According to a first mode of the invention, there is provided an apparatus for image formation, comprising:

an imaging device forming images on record media;

a housing defining a front face, a rear face, both side faces, a top face and a bottom face, to thereby house the imaging device;

a recessed portion configured so as to be openable or accessible at selected at least one of the front face, the both side faces and the top face of the housing; and an attachment mechanism allowing a data-storable external storage device to be attached to the apparatus for electrical connection thereto, the attachment mechanism being in a position allowing the external storage device, when attached to the attachment mechanism, to be accommodated within the recessed portion.

In general, external storage devices such as USB memory devices have been widely deployed, which are capable of storing data for read/write access when directly connected to USB ports, and which are easy to carry.

Similarly to other applications, in applications where images are formed or printed, it has become popular to operate image-reading apparatuses in a manner that image data indicative of an image that has been read by a scanner is written to external storage devices, and that the image data is read from the external storage devices for printing a desired image or images on print media.

This operation can be achieved, for example, by operating the image-forming apparatus incorporating the laser printer as disclosed in the above-mentioned publication, with the external storage device being attached to a USB port of the laser printer.

For this laser printer disclosed in the above-mentioned publication, however, the external storage device is attached to the USB port of the laser printer, so as to project out from the body casing of the laser printer. This can result in inadvertent snagging of a user's hands, clothing or other articles on the projecting external-storage-device, which runs the risk of connections between the USB port and the external storage device being undesirably disconnected, damaged or broken.

In addition, for this laser printer disclosed in the above-mentioned publication, the downsizing of the body casing of the laser printer would not lead to satisfactory savings in the overall space occupied by both the laser printer and the attached external-storage-device, because the external storage device projects out from the body casing of the laser printer, when attached thereto.

In contrast, the apparatus constructed according to the first mode of the invention, a recessed portion is provided and configured so as to be openable at an exposed face of the housing. Further, an attachment mechanism to allow an external storage device to be attached to this apparatus is in a position allowing the external storage device, when attached to the attachment mechanism, to be accommodated within the recessed portion.

This apparatus, as a result, would prevent the external storage device, when attached to the attachment mechanism, from restricting a user working space and from making it more difficult to offer satisfactory space savings.

This apparatus, additionally, may be practiced to allow a user to attach the external storage device to the attachment mechanism, by a user attaching operation on the side of an exposed face (e.g., the front face) of the housing, with greater ease.

According to a second mode of the invention, there is provided the apparatus according to the first mode of the invention, wherein the recessed portion is defined by and on the selected at least one face of the housing, the recessed portion acts as a media exit section configured to have a wall-like structure and an exit tray, the wall-like structure has a media outlet allowing the record media to exit the media outlet into the exit tray after the imaging device forms images on the record media, the exit tray is used for storage of the record media in stack after the record media exits the media outlet into the exit tray, and the attachment mechanism is disposed on the wall-like structure at a predetermined distance away from a reference plane of the exit tray, which is larger than a distance between the media outlet and the reference plane of the exit tray.

This apparatus allows the external storage device, when attached to the attachment mechanism, to be accommodated within the recessed portion of the media exit section, that is to say, not to project out from an exposed face of the housing of this apparatus, owing to the utilization of the recessed portion. The exposed face, such as the top face or the front face of the housing, defines the recessed portion. The media exit section is in the form of, for example, a storage volume which is available to store record media that have been printed on by the imaging device.

Additionally, this apparatus prevents the external storage device, when attached to the attachment mechanism, from impeding or interfering with record media attempting to exit the media outlet, owing to the optimized relative geometry between the attachment mechanism and the exit tray.

In an example, the reference plane of the exit tray is curved with respect to a horizontal plane.

In an example, the "distance" between the attachment mechanism and the reference plane of the exit tray, and the "distance" between the media outlet and the reference plane of the exit tray are measured in a direction in which a plurality of record media (e.g., print sheets) are to be stacked on the exit tray, such as a vertical direction.

According to a third mode of the invention, there is provided the apparatus according to the first or second mode of the invention, wherein the recessed portion includes a recessed handle defined by and on the selected at least one face of the housing, at least for carrying the apparatus.

This apparatus allows the external storage device, when attached to the attachment mechanism, to be accommodated within a recessed area of the recessed handle, that is to say, not to project out from a face of the housing which defines the recessed handle, owing to the utilization of the recessed area of the recessed handle.

According to a fourth mode of the invention, there is provided the apparatus according to any one of the first through third modes of the invention, further comprising a feed tray for use in feeding the record media to the imaging device before the imaging device forms images on the record media, wherein the feed tray is configured to be insertable into and extractable from the housing, the feed tray has a front face defining at least in part the selected at least one face of the housing when the feed tray is inserted in the housing, the recessed portion is defined by and on the front face of the feed tray, and the recessed portion acts as a recessed handle at least for extracting the feed tray from the housing.

According to a fifth mode of the invention, there is provided the apparatus according to the fourth mode of the invention, wherein the attachment mechanism is disposed at the feed tray.

According to a sixth mode of the invention, there is provided the apparatus according to any one of the first through fifth modes of the invention, further comprising an openable member situated selectively in an open position and a closed position, the openable member, when situated in the closed position, occluding the recessed portion.

This apparatus allows the external storage device that has been attached to the attachment mechanism, to be occluded by the openable member situated in the closed position, thereby enabling a user to store the external storage device at a hidden or obscure place located within the housing of this apparatus, for example, for storage of sensitive information in the external storage device.

According to a seventh mode of the invention, there is provided the apparatus according to the sixth mode of the invention, further comprising a feed tray for use in feeding the record media to the imaging device before the imaging device forms images on the record media, wherein the feed tray is configured to be insertable into and extractable from the housing, the recessed portion is defined within the housing when the feed tray is inserted in the housing, and the openable member belongs to the feed tray.

This apparatus allows a user to selectively attach and detach the external storage device to and from the attachment mechanism, by extracting the feed tray from the housing of this apparatus. This apparatus further allows the user to store the external storage device which has been attached to the attachment mechanism, at a hidden or obscure place inside the housing of this apparatus, by inserting the feed tray into the housing of this apparatus.

According to an eighth mode of the invention, there is provided the apparatus according to the seventh mode of the invention, wherein the attachment mechanism is disposed at the feed tray.

This apparatus allows a user to do a manual work for attachment and detachment of the external storage device, with greater efficiency, because of the integral movement of the attachment mechanism with the feed tray.

According to a ninth mode of the invention, there is provided the apparatus according to the seventh or eighth mode of the invention, wherein the recessed portion includes a recessed handle defined by and on the selected at least one face of the housing, at least for extracting the feed tray from the housing.

This apparatus allows the external storage device, when attached to the attachment mechanism, to be accommodated within a recessed area of the recessed handle, that is to say, not to project out from a face of the housing which defines the recessed handle, owing to the utilization of the recessed area of the recessed handle.

According to a tenth mode of the invention, there is provided the apparatus according to any one of the sixth through ninth modes of the invention, wherein the openable member includes an openable cover pivotably coupled to the housing.

This apparatus allows a user to selectively attach and detach the external storage device to and from the attachment mechanism, by placing the openable cover in an open position (e.g., an unfolded position). This apparatus further allows the user to store the external storage device that has been attached to the attachment mechanism, at a hidden or obscure place inside the housing of this apparatus, by moving the openable cover to a closed position (e.g., a retracted position).

According to an eleventh mode of the invention, there is provided the apparatus according to the tenth mode of the invention, further comprising a feed tray for use in feeding the record media to the imaging device before the imaging device forms images on the record media, wherein the feed tray is pivotably coupled to the housing, and the feed tray acts as the openable member.

According to a twelfth mode of the invention, there is provided the apparatus according to the eleventh mode of the invention, wherein the feed tray has a front face and a rear face as viewed when the feed tray is situated in the closed position, and the recessed portion is defined within the housing when the feed tray is situated in the closed position.

According to a thirteenth mode of the invention, there is provided the apparatus according to the twelfth mode of the invention, wherein the attachment mechanism is disposed at a predetermined position within the housing, which is located opposing to the rear face of the feed tray situated in the closed position.

According to a fourteenth mode of the invention, there is provided an apparatus for image formation, comprising:

an imaging device forming images on sheets;

a housing that houses the imaging device;

a sheet outlet through which the sheets pass to exit the apparatus after image formation by the imaging device;

a sheet exit tray formed integrally with the housing to store the sheets after exiting the sheet outlet; and an attachment mechanism allowing a data-storable external storage device to be detachably attached to the apparatus for electrical connection thereto, wherein the sheet exit tray is configured to have a recessed portion in a position allowing an user to access the recessed portion, the sheet exit tray storing the sheets in stack on the recessed portion, and the attachment mechanism is in a position allowing the user to access the external storage device, when attached to the attachment mechanism at least temporarily, and allowing the external storage device, when attached to the attachment mechanism, to be accommodated within the recessed portion, without interfering with storage of the sheets on the recessed portion.

According to a fifteenth mode of the invention, there is provided the apparatus according to the fourteenth mode of the invention, wherein the attachment mechanism is disposed in the vicinity of the sheet exit.

According to a sixteenth mode of the invention, there is provided the apparatus according to the fifteenth or sixteenth mode of the invention, wherein the external storage device is elongated-plate shaped, and the attachment mechanism is oriented in a direction allowing the external storage device, when attached to the attachment mechanism, to be generally in parallel to a path in which the sheets travel from the sheet outlet to the sheet exit tray.

According to a seventeenth mode of the invention, there is provided the apparatus according to any one of the fourteenth through sixteenth modes of the invention, wherein the external storage device is elongated-plate shaped, and the attachment mechanism is oriented in a direction allowing the external storage device, when attached to the attachment mechanism, to be generally in parallel to a surface of an uppermost one of the sheets stacked on the sheet exit tray.

Several presently preferred embodiments of the invention will be described in more detail by reference to the drawings in which like numerals are used to indicate like elements throughout.

First Illustrative Embodiment

Referring now to FIGS. 1-4, there will be described the overall configuration of a laser printer 1 constructed according to a first illustrative embodiment of the present invention. This laser printer 1 constitutes an example of the "apparatus" set forth in the above-described first mode of the present invention.

Figure 2:
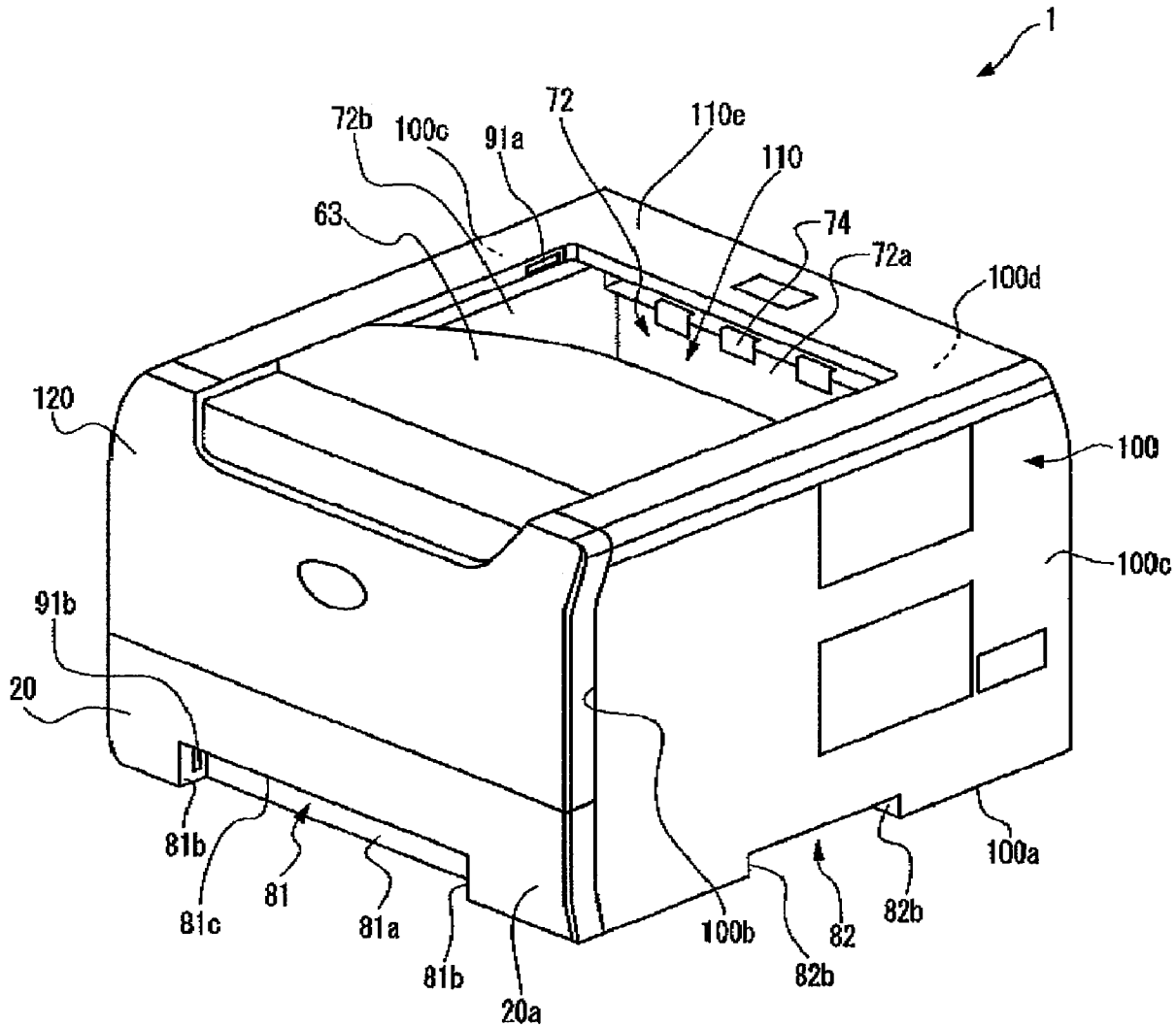
FIG. 2 is a perspective view illustrating the exterior of the laser printer 1 depicted in FIG. 1, with the image reader 300 being omitted in the illustration, FIG. 2 also illustrating the features of a laser printer 1 constructed according to a second illustrative embodiment of the invention.
Figure 3:
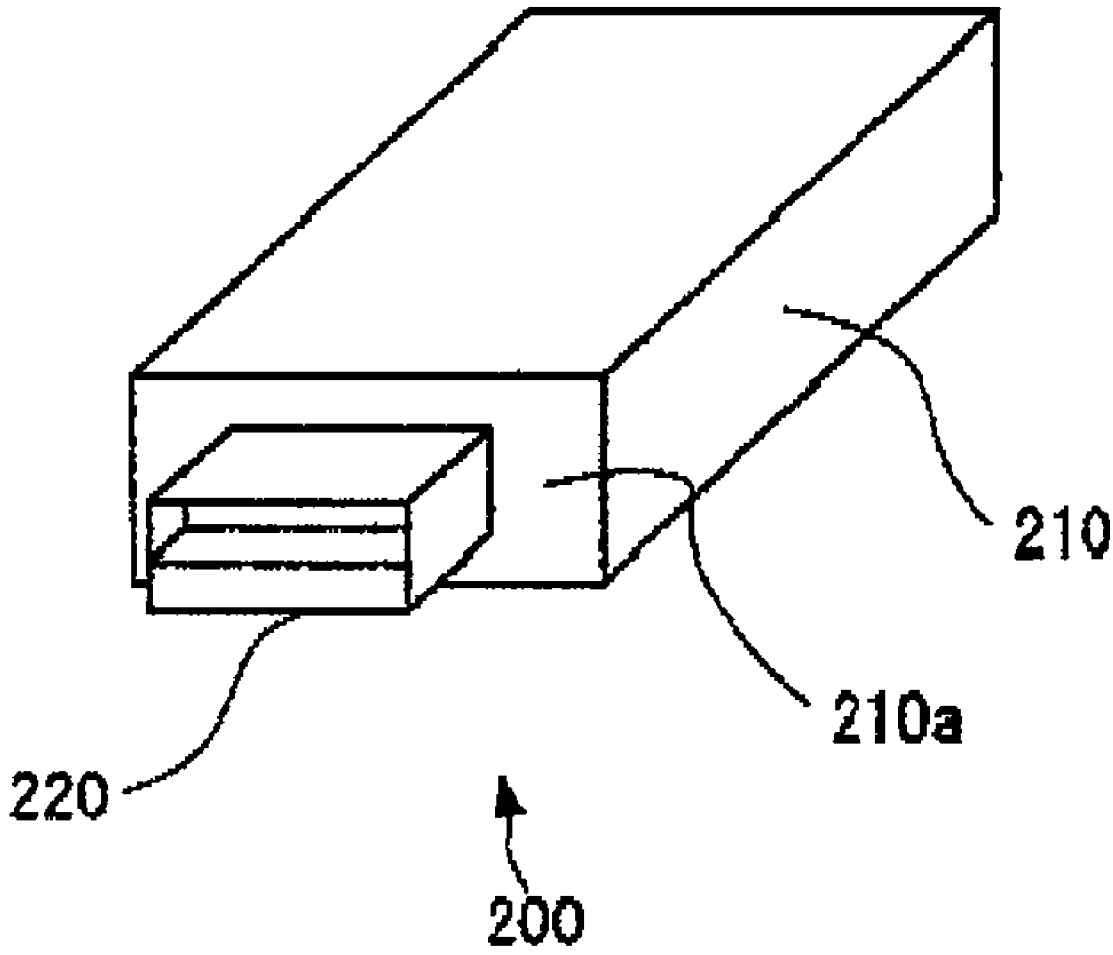
FIG. 3 is a perspective view illustrating a USB memory device 200 to be attached to the laser printer depicted in FIG. 2.
Figure 4:
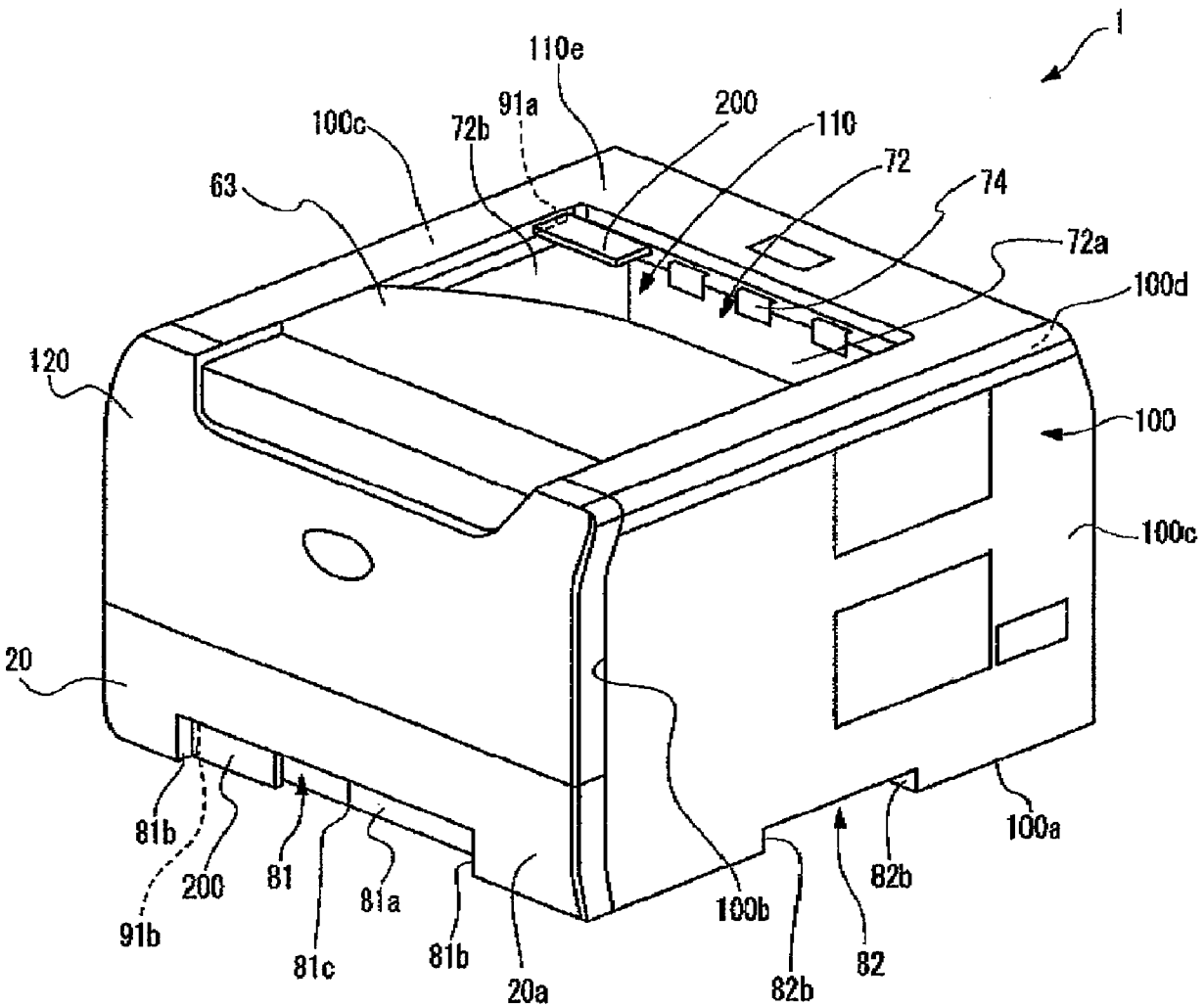
FIG. 4 is a perspective view illustrating the exterior of the laser printer 1 depicted in FIG. 2, with the USB memory device 200 being attached to the laser printer 1.

FIG. 1 is a mid-sectional view illustrating the laser printer 1 incorporating an image reader 300. FIG. 2 is a perspective view illustrating the exterior of the laser printer 1, with the image reader 300 being omitted in the illustration. FIG. 3 is a perspective view illustrating a USB memory device 200. FIG. 4 is a perspective view illustrating the exterior of the laser printer 1 depicted in FIG. 2, with the USB memory device 200 being attached to the laser printer 1.

It is noted that, as used below in the description, a direction indicated by arrow A in FIG. 1 will be referred to as "forward direction" or "forward," while the opposite direction, as indicated by arrow B in this figure, will be referred to as "rearward direction" or "rearward."

As illustrated in FIG. 1, the laser printer (hereinafter referred to also as "printer") 1 includes a body casing 100 (an example of the "housing" set forth in the above-described first mode of the present invention) and the image reader 300. The body casing 100 includes therein a paper feed unit 2, a process unit 3 (an example of the "imaging device" set forth in the above-described first mode of the present invention), and a paper exit unit 6.

Interior Configuration of Body Casing

The body casing 100 houses the paper feed unit 2, the process unit 3, etc. The exterior configuration of the printer 1 together with the configuration of the body casing 100 will be described later on in more detail.

As illustrated in FIG. 1, the paper feed unit 2, disposed in a lower portion of the body casing 100, is adapted to feed paper sheets P (an example of the "record media" set forth in the above-described first mode of the present invention) to the process unit 3. The process unit 3, disposed above the paper feed unit 2, is adapted to form images on the surface of a paper sheet P that has been fed from the paper feed unit 2. The paper exit unit 6 is adapted to discharge a paper sheet P after the process unit 3 forms images on the surface of the paper sheet P.

Configuration of Paper Feed Unit

The paper feed unit 2 includes therein a paper feed tray 20, pick-up rollers 21 and 27, a separation roller 22, a separation pad 23, a guide 24, a registration roller 25, a registration free-roller 26, and a manual feed tray 120.

It is noted that the paper feed tray 20 constitutes an example of the "openable member" set forth in the sixth mode of the present invention), and the manual feed tray 120 constitutes an example of the "openable member" set forth in the sixth mode of the present invention and an example of the "openable cover" set forth in the tenth mode of the present invention.

The paper feed tray 20, which is extractable forwardly away from the body casing 100, has a box-like shape having an open top face. The paper feed tray 20 allows a number of paper sheets P to be stacked.

The pick-up roller 21, disposed over a front-end portion of the paper feed tray 20, operates to transport paper sheets P stacked on the paper feed tray 20 toward the separation roller 22.

The separation roller 22 cooperates with the opposed separation pad 23 to hold a paper sheet P fed from the pick-up roller 21, under pressure, for retrieving the stacked paper sheets P one-by-one and transporting the retrieved one to the guide 24.

The guide 24 is configured to direct a paper sheet P from the separation roller 22 to the registration roller 25, while curling the paper sheet P into a general U-shape.

Figure 9:
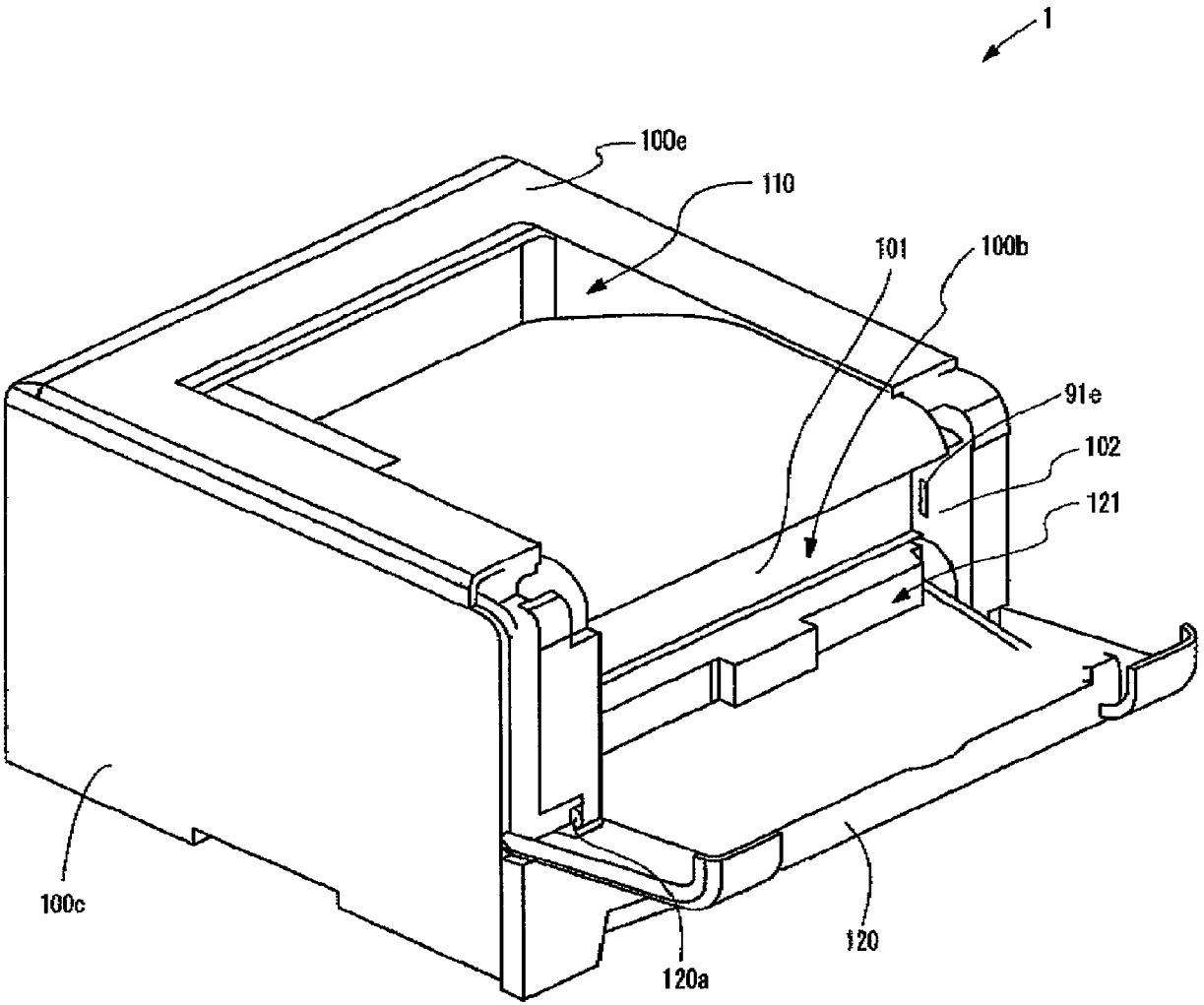
FIG. 9 is a perspective view illustrating a laser printer 1 constructed according to a fifth illustrative embodiment of the invention, with a manual feed tray 120 being in an open position.

The manual feed tray 120 is disposed so as to be pivotable about a support shaft 120*a* in the forward direction away from the body casing 100. The manual feed tray 120, when pivoted forward, is eventually brought into an extreme position in which the manual feed tray 120 is held generally horizontally, as illustrated in FIG. 9. A fresh paper sheet P, when loaded in the thus-positioned manual feed tray 120, becomes capable of being fed from a manual-feed paper inlet 121.

The manual feed tray 120 is pivotable between a closed position (or a retracted position or folded position) and an open position (or an extended position or unfolded position). In the open position, a user is accessible to components located within the body casing 100 through an opening temporarily defined by the manual feed tray 120.

The pick-up roller 27, disposed behind the manual-feed paper inlet 121, transports a paper sheet P from the manual feed tray 120 situated in a forwardly-extended position, toward the registration roller 25.

The registration roller 25, disposed in opposing relationship to the registration free-roller 26, operates to stop a leading edge of a paper sheet P entered after being directed by the guide 24, or a leading edge of a paper sheet P entered after being transported by the pick-up roller 27, when there is the need to deskew the paper sheet P. Thereafter, the registration roller 25 transports a paper sheet P, with a predetermined timing, into a contact position between a photosensitive drum 34 and a transfer roller 39 both accommodated within the process unit 3 as described later on.

Configuration of Process Unit

The process unit 3 includes a drum cartridge 32, a developer cartridge 34, a scanner 33, and a fuser unit 50.

The scanner 33, disposed in the upper portion of the printer 1, includes a laser emission device, a mirror, a lens and the like, all of which are not shown. In the scanner 33, a laser beam emitted from the laser emission device and modulated based on predetermined image-data, is reflected from the mirror or transmitted through the lens. Thereafter, the surface of a photosensitive drum 31 is illuminated with (i.e., exposed to) the reflected or transmitted laser-beam, to thereby form an electrostatic latent image on the surface of the photosensitive drum 31.

The developer cartridge 34, detachably mounted on the drum cartridge 32, includes a developer roller 35, a supply roller 36, and a developer-material container chamber 37 for storage of a developer material.

In the developer-material container chamber 37, there is disposed an agitator 40 which is rotatably driven to agitate the developer material stored in the developer-material container chamber 37 and to deliver the developer material to the supply roller 36.

The supply roller 36, disposed in the vicinity of the developer-material container chamber 37, operates to supply the developer material from the agitator 40 to the developer roller 35.

To the surface of the developer roller 35 opposing to the supply roller 36, a positive development-bias is applied. The developer material delivered from the supply roller 36 is positively charged to a predetermined potential, owing to both sliding contact made between the developer roller 35 and the supply roller 36, and the development bias.

A positively charged developer material, when supplied from the developer roller 35 to the photosensitive drum 31 on which an electrostatic latent image has been developed, is attracted only to a portion of the surface of the photosensitive drum 31 which has been exposed to a laser beam and which has been reduced in potential accordingly. Thus, an electrostatic latent image is developed into a visualized developer-image.

The drum cartridge 32, detachably mounted on the printer 1 and disposed below the scanner 33, includes the photosensitive drum 31, the transfer roller 39, a charger 38, and the registration free-roller 26.

The photosensitive drum 31 is a cylindrical drum having a surface on which a photosensitive resin layer has been formed. The photosensitive drum 31 is opposed to the developer roller 35.

The charger 38 of a scorotron-type is disposed above the photosensitive drum 31 in opposing relationship thereto with a space left therebetween. The charger 38 introduces a positive charge on the surface of the photosensitive drum 31.

To the surface of the transfer roller 39 opposed to the photosensitive drum 31, a negative transfer-bias is applied. The transfer roller 39 cooperates with the photosensitive drum 39 to hold a paper sheet P under pressure at a zone between the transfer roller 39 and a portion of the surface portion of the photosensitive drum 39 on which a developer image has been developed, with a transfer bias being applied to the surface of the transfer roller 39. Thus, a developer image is transferred onto the surface of a paper sheet P.

The fuser unit 50 includes a heat roller 51 and a pressure roller 52.

The heat roller 51 includes a heater for heating and melting a developer material, to thereby heat-fuse a developer image which has been transferred onto a paper sheet P located between the photosensitive drum 31 and the transfer roller 39, on the paper sheet P, at an area between the heat roller 51 and the pressure roller 52 which is pressed against the heat roller 51.

Configuration of Paper Exit Unit

The paper exit unit 6 includes guides 61 and 62, a paper exit tray 63, a paper exit roller device 64, and a paper exit section 110.

The guides 61 and 62 cooperate to direct a paper sheet P from the fuser unit 50 to the paper exit roller device 64, while curing the paper sheet P into a general U-shape.

The paper exit roller device 64 is comprised of a rotatably driven drive-roller 64*a* and a free roller 64*b* that rotates to follow the rotation of the drive roller 64*a*, to thereby discharge a paper sheet P entered from the guides 61 and 62, to the paper exit tray 63 of the paper exit section 110.

The paper exit section 110 includes a paper-exit wall-like structure 72 on which a paper outlet 74 (see FIG. 2) is formed, and the paper exit tray 63. The paper-exit wall-like structure 72 constitutes an example of the "wall-like structure" set forth in the above-described second mode of the present invention.

The paper exit tray 63, which is integrally formed with the body casing 100, is adapted to store a stack of paper sheets P which have exited the paper outlet 74. Paper sheets P are transported to the paper outlet 74, as a result of the operation of the drive and free rollers 64*a* and 64*b* which hold the paper sheets P therebetween.

Exterior Configuration of Body Casing

As illustrated in FIG. 2, the body casing 100 has six faces consisting of a bottom face 100*a*, a front face 100*b*, both side faces 100*c* and 100*c*, a rear face 100*d*, and an upper face 100*e*.

The bottom face 100*a* acts as a physical interface with a separate object (e.g., a floor, a desk top or a table) on which the printer 1 is placed. The front face 100*b* is covered with a front face of the paper feed tray 20 and a front face of the manual feed tray 120. On the rear face 100*d*, there are provided connectors (not shown) allowing connection with cables extending out from personal computers, receptacles or sockets (not shown) or the like. In the upper face 100*e*, the paper exit section 110 is provided for storage of paper sheets P which have exited the paper outlet 74.

A top face of the printer 1 is comprised of the upper face 100*e* of the body casing 100, and the paper exit section 110 formed in the upper face 100*e*.

As described above, the paper exit section 110 includes the paper-exit wall-like-structure 72 having the paper outlet 74 through which a paper sheet P exits after an image has been formed on the paper sheet P, the paper exit tray 63 used for storage of a stack of paper sheets P which have exited the paper outlet 74 into the paper exit tray 63, and the like.

The paper-exit wall-like-structure 72 has three faces consisting of a paper-exit wall 72*a* which is in parallel to the rear face 100*d* of the body casing 100 and which has the paper outlet 74, and a pair of side walls 72*b* and 72*b* which are in parallel to the both side faces 100*c*. The paper-exit wall-like-structure 72 is shaped perpendicularly to the upper face 100*e* of the body casing 100.

The paper exit tray 63 is formed so as to intersect or meet the paper-exit wall 72*a* and the both side walls 72*b* and 72*b*.

The paper exit tray 63 has an inclined section with respect to a horizontal plane, and a generally horizontal section, both of which are in a linear array.

In the inclined section, the paper exit tray 63 gradually rises when going forward from an intersection with the paper-exit wall 72*a*. On the other hand, the generally horizontal section spans from a position at which the paper exit tray 63 is generally equal in height to the upper face 100*e* of the body casing 100, to the front face 100*b* of the body casing 100.

These three walls 72*a*, 72*b* and 72*b* constituting the paper-exit wall-like-structure 72, and the paper exit tray 63 together define a recessed portion in the upper face 100*e* of the body casing 100.

A recessed USB socket (an example of the "attachment mechanism" of the above-described first mode of the present invention) 91*a* is mounted onto one or both of the side walls 72*b* and 72*b* at a predetermined vertical-distance D1 away from a reference plane RP of the paper exit tray 63, as described later on in more detail. The vertical distance D1 is set so as to be larger than a vertical distance D2 between the reference plane RP of the paper exit tray 63 and the vertical position of the paper outlet 74.

Figure 11:
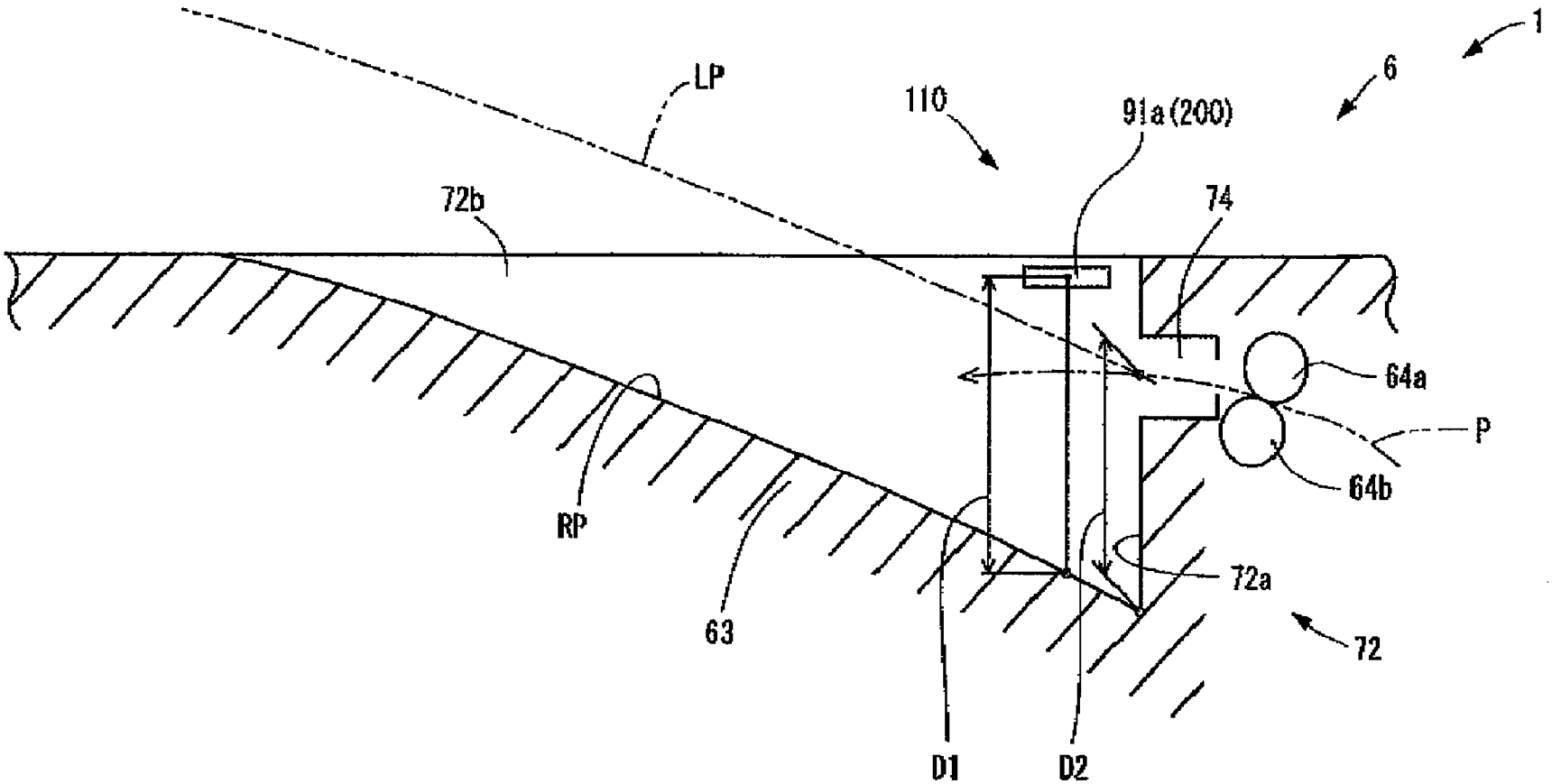
FIG. 11 is a side view illustrating the relative geometry among the USB memory device 200, a paper outlet 74, and a paper exit tray 63, all depicted in FIG. 1.

In FIG. 11, there is illustrated the relative geometry among the paper exit tray 63, the paper outlet 74 and the USB socket 91*a*. The paper exit tray 63 defines the reference plane RP representative of the curved profile of the surface of the paper exit tray 63.

In FIG. 11, there is illustrated in phantom line an upper limit plane LP which is offset vertically from the reference plane RP, by the vertical distance D2 between the paper outlet 74 and the reference plane RP. The vertical distance D2 is generally equal to a maximum thickness of paper sheets P that can be stacked within the paper exit tray 63.

The USB socket 91*a* is located above the upper limit plane LP, meaning that the vertical distance between the USB socket 91*a* and the reference plane RP is larger than the vertical distance between the paper outlet 74 and the reference plane RP.

It is noted that the USB socket 91*a* is disposed in the vicinity of the paper outlet 74, and is oriented in a direction allowing the USB memory device 200, when attached to the USB socket 91*a*, to be generally in parallel to a path in which paper sheets P travel from the paper outlet 74 to the paper exit tray 63.

Referring then to FIG. 3, there is attachable to the USB socket 91*a*, such a USB memory device 200 (an example of the "external storage device" of the above-described first mode of the present invention) as illustrated in FIG. 3.

As well-known in the art, the USB memory device 200 is configured to have a main body 210 incorporating a flash memory (not shown), and a plug 220 which projects away from an end of the main body 210.

The USB memory device 200 is operable, upon reception of data from the external, to capture the data through the plug 220 and write the data into the flash memory, and is also operable to access data stored in the flash memory and send the data to the external.

Insertion of the plug 220 of the USB memory device 200 into the USB socket 91*a* allows the USB memory device 200 to be attached to the printer 1, resulting in establishment of electrical coupling between the USB memory device 200 and the printer 1.

As illustrated in FIG. 4, when the USB memory device 200 is attached to the USB socket 91*a* (see FIG. 2) provided on one or both of the side walls 72*b*, 72*b* (or a portion of the body casing 100 which defines the upper face 100*e* of the body casing 100), the elongated-plate shaped USB memory device 200 is held by the USB socket 91*a* in a position allowing the USB memory device 200 to extend in parallel to the upper face 100*e* of the body casing 100, and to be located below the upper face 100*e* of the body casing 100, that is to say, inside the body casing 100.

Configuration of Image Reader

As illustrated in FIG. 1, the image reader 300 is a flatbed-type scanner which includes a platen glass 303 for receiving a document (not shown) thereon, an image sensor 301 for reading images formed on a document placed on the platen glass 303, and a document cover 305 which is movable (e.g., pivotable) between an open position with respect to the platen glass 303 and a closed position allowing the platen glass 303 to be covered with the document cover 305.

The image reader 300 is configured so as to be pivotable about a support shaft 307 in the rearward direction with respect to the body casing 100.

When the document cover 305 is opened and a document is placed on the platen glass 303, an image formed on the document is read by the image sensor 301. Based on image data indicative of the image read by the image sensor 301, the process unit 3 forms an image on a paper sheet P. The printer 1, because of incorporation of the image reader 300, can provide a so-called copying function.

Operation of Printer Using USB Memory Device

The operation of the printer 1 using the USB memory device 200 will be described below.

Direct Printing Operation

As illustrated in FIG. 4, once the USB memory device 200 which has stored therein image data is attached to the USB socket 91*a*, the printer 1 starts accessing image data stored in the USB memory device 200, and activates the process unit 3, based on the accessed image data, to perform a so-called direct printing operation in which an image is formed on a paper sheet P.

"Scan-to-Memory" Operation

Once the USB memory device 200 is attached to the USB socket 91*a* and a document is placed on the platen glass 303 of the image reader 300, the printer 1 performs a so-called "Scan to Memory" operation in which the printer 1 captures image data from the placed document through the image sensor 301, and writes the captured image data into the USB memory device 200.

Exemplary Advantageous Effects

As will be evident from the above explanation, the USB memory device 200, when attached to the USB socket 91*a*, is accommodated within a recessed portion defined by the paper exit section 110 such that the USB memory device 200 is located below the upper face 100*e* of the body casing 100 and inside the printer 1. In other words, the USB memory device 200, when attached to the USB socket 91*a*, does not project out from the body housing 100.

This prevents inadvertent snagging of a user's hands, clothing or other articles on the USB memory device 200 which has been attached to the USB socket 91*a*.

As a result, the USB memory device 200 is prevented from experiencing undesirable disconnection due to user's inadvertent engagement, and also the USB socket 91*a* and the plug 220 of the USB memory device 200 are prevented from being damaged or broken due to user's inadvertent engagement.

In addition, the printer 1 is advantageous in saving space to be occupied by the printer 1, because the USB memory device 200 does not require any additional space.

Moreover, the recessed portion defined by the paper exit section 110 for storage of a stack of discharged paper sheets P is utilized for accommodating the USB memory device 200, thereby eliminating the necessity of forming in the printer 1 an additional and exclusive recessed-portion for accommodating the USB memory device 200.

Still moreover, the upper face 100*e* of the body casing 100, during operations, is covered with the image reader 300, thereby allowing the recessed portion of the paper exit section 110 within which the USB memory device 200 is accommodated, to be occluded by the image reader 300.

As a result, the USB memory device 200 is located in a hidden or obscure placer resulting in the enhanced security for the high portability of the USB memory device 200 for transporting data from one location to another.

Further, the USB socket 91*a* is disposed in the vicinity of the upper face 100*e* of the body casing 100, thereby making it easier for a user to do manual work on the front side of the printer 1, for attachment and detachment of the USB memory device 200 to and from the USB socket 91*a*, after pivoting the image reader 300 about the support shaft 307 to a rearward position (e.g., a rearmost position).

Still further, the USB socket 91*a* is disposed on at least one of the side walls 72*b* and 72*b* at a predetermined distance vertically away from the reference plane RP of the paper exit tray 63, the distance being larger than a distance between the reference plane RP of the paper exit tray 63 and the position of the paper outlet 74, thereby preventing the USB memory device 200 which has been attached to the USB socket 91*a*, from interfering with desirable discharge of paper sheets P from the paper outlet 74 and desirable storage of discharged paper sheets P on the paper exit tray 63.

Second Illustrative Embodiment

Referring next to FIGS. 2-5, a printer 1 constructed according to a second illustrative embodiment of the invention will be described below.

Figure 5:
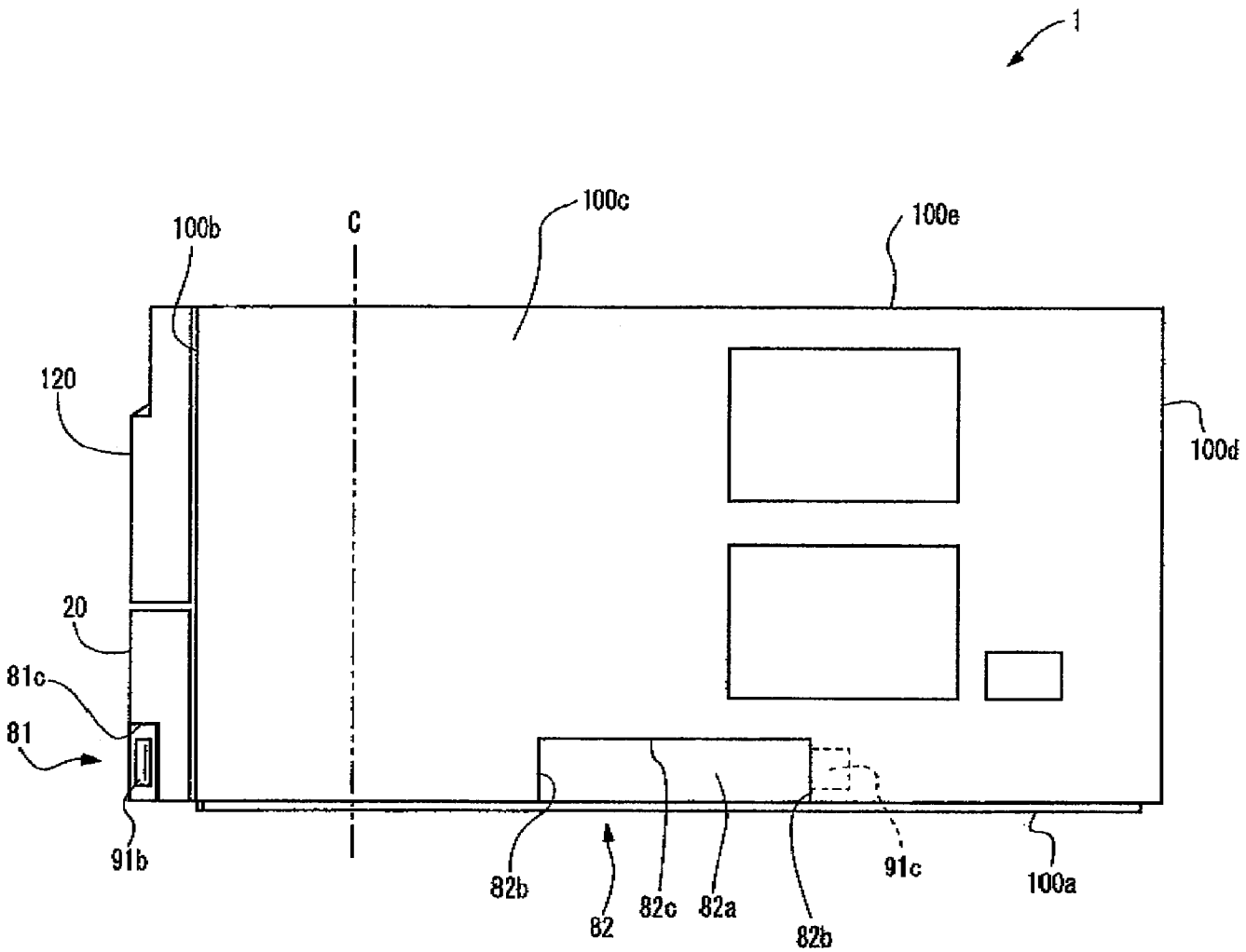
FIG. 5 is, for illustration of the laser printer 1 constructed according to the second illustrative embodiment of the invention, a combined view of a mid-sectional view illustrating a first portion of the laser printer 1 which is located on the left-hand side with respect to line C, and a side view illustrating a second portion of the laser printer 1 which is located on the right-hand side with respect to line C, the first portion being located on the front side with respect to line C when viewing a right-hand side face 100*c* depicted in FIG. 2, the second portion being located on the rear side with respect to line C when viewing the right-hand side face 100*c*, FIG. 5 also illustrating the features of a laser printer 1 constructed according to a third illustrative embodiment of the invention.

FIG. 5 is a combined view of a mid-sectional view illustrating a first portion of the laser printer 1 which is located on the left-hand side with respect to line C, and a side view illustrating a second portion of the laser printer 1 which is located on the right-hand side with respect to line C.

In FIG. 5, the first portion is located on the front side with respect to line C when viewing a right-hand side face 100*c* depicted in FIG. 2, while the second portion is located on the rear side with respect to line C when viewing the right-hand side face 100*c*.

The present embodiment is different from the first embodiment only with respect to elements concerning a position at which a USB socket is mounted on the printer 1, and is common to the first embodiment with respect to the remaining elements. Therefore, the common elements of the present embodiment will be omitted in the description.

As illustrated in FIG. 2, a lower portion of the front face 100*b* of the body casing 100 is covered with the front face 20*a* of the paper feed tray 20.

The paper feed tray 20 is retracted in the body casing 100 during printing, and, once a user grips a recessed handle 81 (see FIG. 2) formed on the front face 20*a* of the paper feed tray 20 and pulls the paper feed tray 20, the paper feed tray 20 is extracted forward away from the body casing 100.

As illustrated in FIGS. 2 and 5, the handle 81 is defined by four faces comprised of an elongated wall 81*a* laterally extending and forwardly facing, two sidewalls 81*b* and 81*b* positioned at opposite longitudinal ends of the wall 81*a*, and an elongated ceiling 81*c* laterally extending and downwardly facing.

In the present embodiment, onto at least one of the two side walls 81*b* and 81*b* (i.e., only the left-hand side wall 81*b* in FIG. 2, in the present embodiment), a USB socket 91*b* is mounted.

As illustrated in FIG. 4, when the USB memory device 200 is attached to the USB socket 91*b*, the USB memory device 200 is oriented at a right angle to the associated side wall 81*b*, and is extended along the longitudinally-elongated surface of the wall 81*a* in closely-spaced face-to-face relationship therewith.

In this attachment position, there are in physical contact between the associated side wall 81*b* to which the USB memory device 200 has been attached, and an end face 210*a* (see FIG. 3) of the main body 210 of the USB memory device 200, from which the plug 220 projects out.

It is noted that the wall 81*a* and the ceiling 81*c* are each dimensioned to have a longer longitudinal extent than that of the USB memory device 200. The associated side wall 81*b* is dimensioned to have a surface larger than that of the end face 210*a* of the USB memory device 200. The USB socket 91*b* is located at such a position on the associated side wall 81*b*, that the end face 210*a* of the USB memory device 200, when attached to the USB socket 91*b* is entirely accommodated within the surface of the associated side wall 81*b*, without outward protrusion therefrom.

As will be evident from the above explanation, the USB memory device 200, when attached to the USB socket 91*b*, is accommodated within the handle 81 such that the USB memory device 200 is located rearward of a foremost surface of the front face 20*a* of the paper feed tray 20 and therefore inside the printer 1. In other words the USB memory device 200, when attached to the USB socket 91*b*, does not project out from the front face 20*a* of the paper feed tray 20.

This prevents inadvertent snagging of a user's hands, clothing or other articles on the USB memory device 200 which has been attached to the USB socket 91*b*.

As a result, the USB memory device 200 is prevented from experiencing undesirable disconnection due to user's inadvertent engagement, and also the USB socket 91*b* and the plug 220 of the USB memory device 200 are prevented from being damaged or broken due to user's inadvertent engagement.

In addition, the printer 1 is advantageous in saving space to be occupied by the printer 1, because the USB memory device 200 does not require any additional space.

Moreover, the handle 81 used for extracting the paper feed tray 20 from the body casing 100 is utilized for accommodating the USB memory device 200, thereby eliminating the necessity of forming in the body casing 100 an additional and exclusive recessed-portion for accommodating the USB memory device 200.

Still moreover, the USB socket 91*b* is disposed on the front face 20*a* of the paper feed tray 20, that is to say, on the front side of the printer 1, thereby making it easier for a user to do manual work on the front side of the printer 1, for attachment and detachment of the USB memory device 200 to and from the USB socket 91*b*.

Third Illustrative Embodiment

Figure 6:
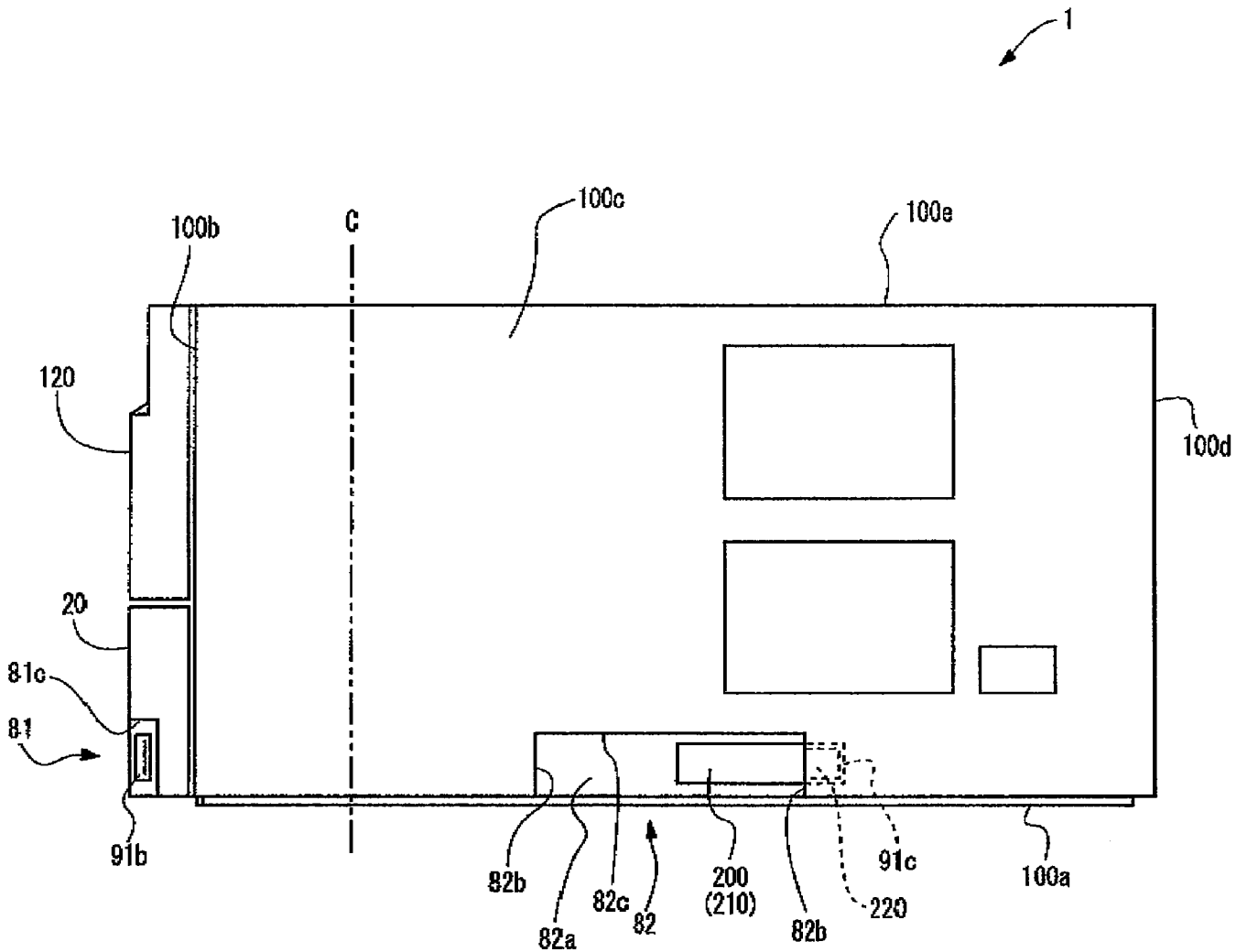
FIG. 6 is a view similar to FIG. 5, except that the USB memory device 200 has been attached to the laser printer 1.

Referring next to FIGS. 5 and 6, a printer 1 constructed according to a third illustrative embodiment of the invention will be described below.

FIG. 6 is a view similar to FIG. 5 described above, except that the USB memory device 200 has been attached to the laser printer 1.

The present embodiment is different from the first embodiment only with respect to elements concerning a position at which a USB socket is mounted on the printer 1, and is common to the first embodiment with respect to the remaining elements. Therefore, the common elements of the present embodiment will be omitted in the description.

As illustrated in FIGS. 2 and 5, the both side faces 100*c* of the body casing 100 include recessed handles 82 at a bottom portion of the body casing 100. Each handle 82 has a shape suitable for allowing the printer 1 to hang on a user's hand thereby enabling the user to carry the printer 1.

Each handle 82 is defined by four faces comprised of an elongated wall 82*a* extending in the forward/rearward direction (a lateral direction in FIG. 5) and laterally (frontally in FIG. 5) facing, two side walls 82*b* and 82*b* positioned at opposite longitudinal ends of the wall 82*a*, and an elongated ceiling 82*c* extending in the forward/rearward direction (laterally in FIG. 5) and downwardly facing.

In the present embodiment, onto at least one of the two side walls 82*b* and 82*b* (i.e., only the right-hand side wall 81*b* in FIG. 5, in the present embodiment), a USB socket 91*c* is mounted.

As illustrated in FIG. 6, the USB memory device 200, when attached to the USB socket 91*c*, is oriented at a right angle to the side walls 82*b* and 82*b*, and is extended along the longitudinally-elongated surface of the wall 82*a* in closely-spaced face-to-face relationship therewith.

In this attachment position, there are in physical contact between the associated side wall 82*b* to which the USB memory device 200 has been attached, and the end face 210*a* (see FIG. 3) of the main body 210 of the USB memory device 200.

It is noted that the wall 82*a* and the ceiling 82*c* are each dimensioned to have a longer longitudinal extent than that of the USB memory device 200. The associated side wall 82*b* is dimensioned to have a surface larger than that of the end face 210*a* of the USB memory device 200. The USB socket 91*c* is located at such a position on the associated side wall 82*b*, that the end face 210*a* of the USB memory device 200, when attached to the USB socket 91*c*, is entirely accommodated within the surface of the associated side wall 82*b*, without outward protrusion therefrom.

As will be evident from the above explanation, the USB memory device 200, when attached to the USB socket 91*c*, is accommodated within the handle 82 such that the USB memory device 200 is located inwardly of a corresponding one of the both side faces 100*c* and 100*c* of the body casing 100 and therefore inside the printer 1. In other words, the USB memory device 200, when attached to the USB socket 91*c*, does not project out from the corresponding side face 100*c* of the body casing 100.

This prevents inadvertent snagging of a user's hands, clothing or other articles on the USB memory device 200, when attached to the USB socket 91*c*.

As a result, the USB memory device 200 is prevented from experiencing undesirable disconnection due to user's inadvertent engagement, and also the USB socket 91*c* and the plug 220 of the USB memory device 200 are prevented from being damaged or broken due to user's inadvertent engagement.

In addition, the printer 1 is advantageous in saving space to be occupied by the printer 1, because the USB memory device 200 does not require any additional space.

Moreover, the handle 82 used for carrying the printer 1 is utilized for accommodating the USB memory device 200, thereby eliminating the necessity of forming in the body casing 100 an additional and exclusive recessed-portion for accommodating the USB memory device 200.

Still moreover, the USB socket 91*c* is disposed on the corresponding side face 100*c* of the body casing 100, thereby making it easier for a user to do manual work on the front side of the printer 1, for attachment and detachment of the USB memory device 200 to and from the USB socket 91*c*.

Especially when one of the both side walls 82*b* and 82*b* which is disposed more rearward than the other is selected, and when the USB socket 91*c* is mounted onto the selected side wall 82*b* (i.e., a rearward side wall 82*b*, or the right-hand side wall 82*b* in FIG. 6), a user who is on the front side of the printer 1 can visually perceive the position of the USB socket 91*c*. This makes it far easier for the user to do manual work on the front side of the printer 1, for attachment and detachment of the USB memory device 200 to and from the USB socket 91*c*.

Fourth Illustrative Embodiment

Figure 7:
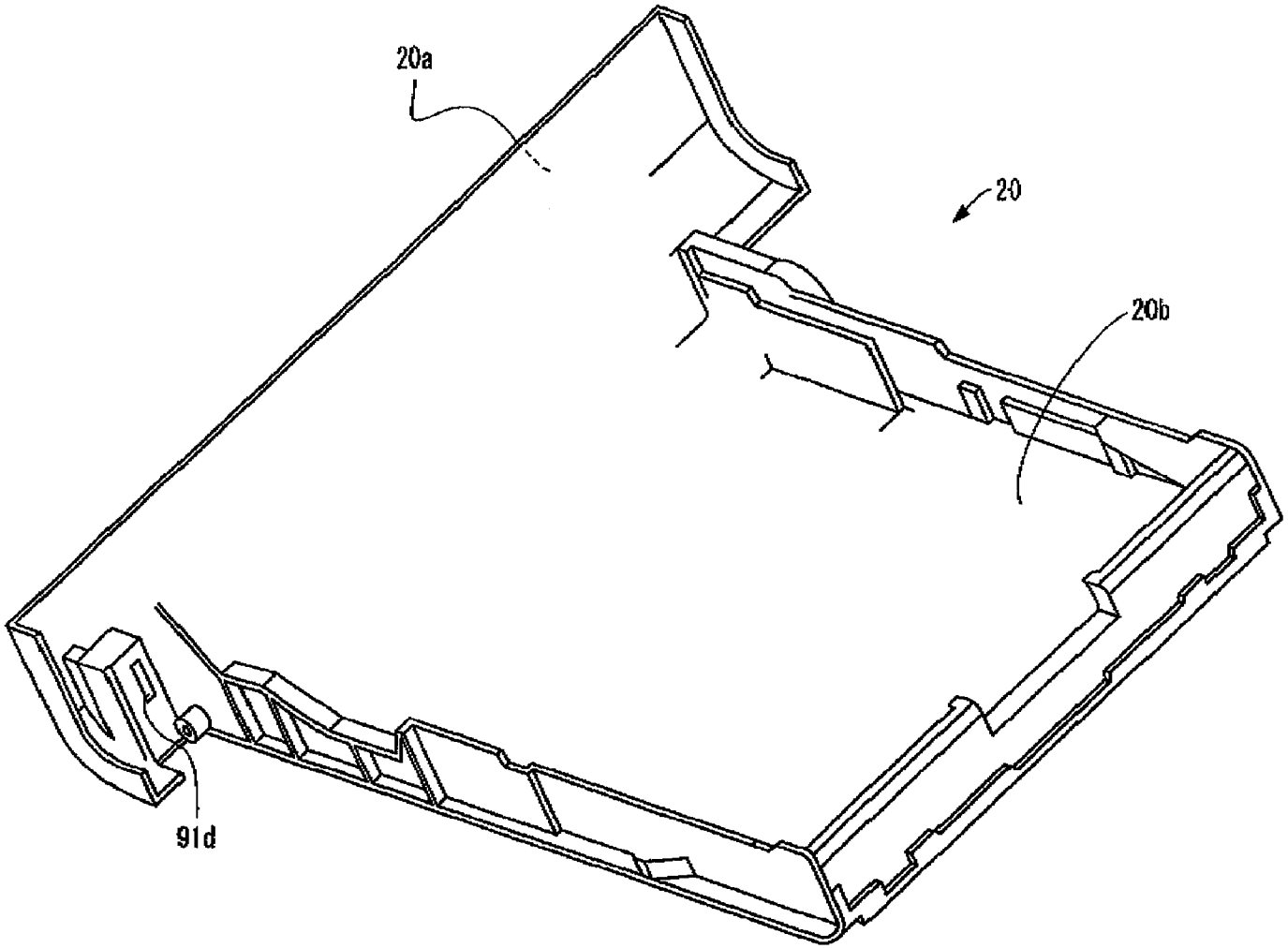
FIG. 7 is a perspective view illustrating a paper feed tray 20 included in a laser printer 1 constructed according to a fourth illustrative embodiment of the invention.
Figure 8:
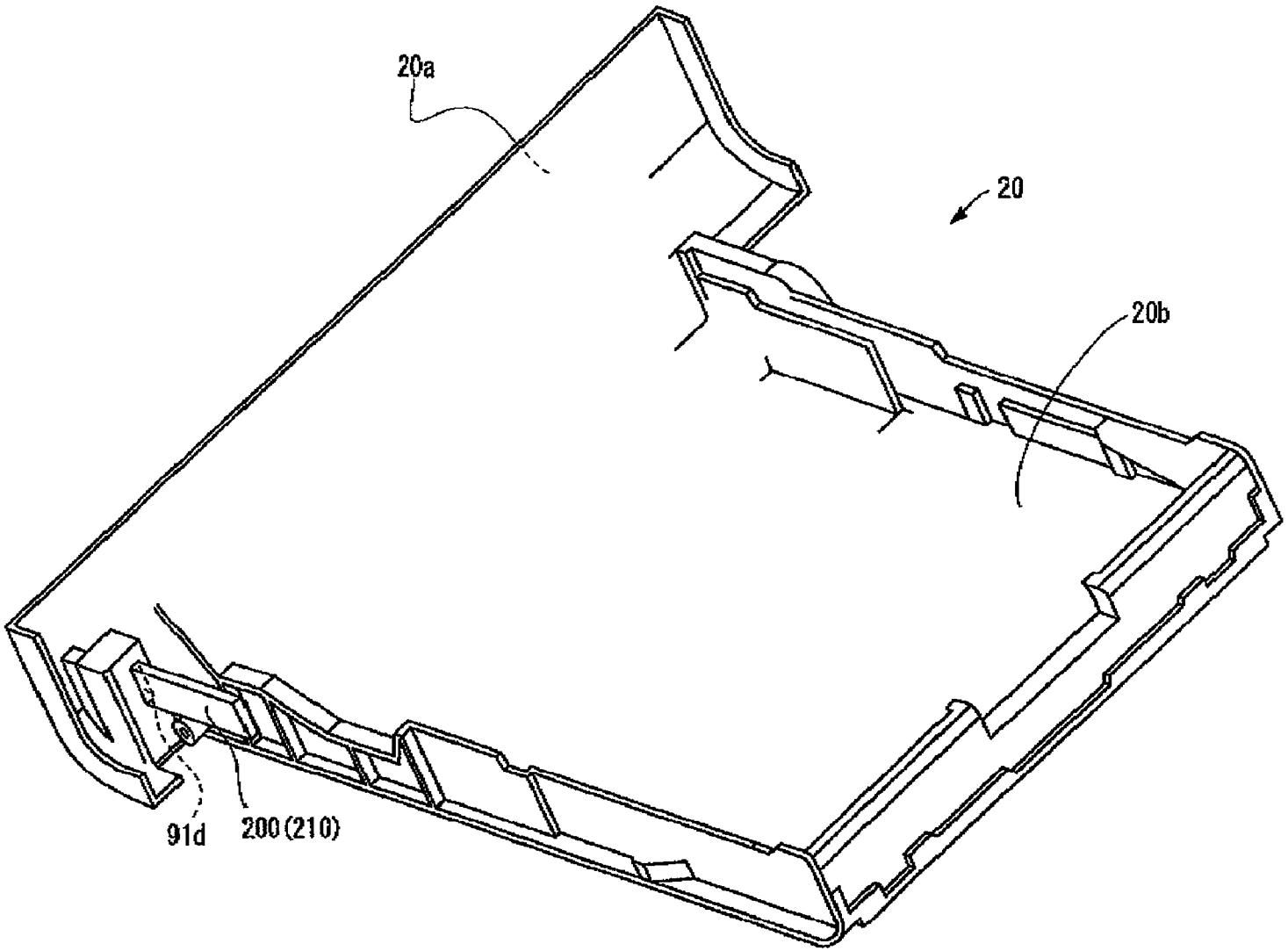
FIG. 8 is a view similar to FIG. 7, except that the USB memory device 200 has been attached to the paper feed tray 20.

Referring next to FIGS. 7 and 8, a laser printer 1 constructed according to a fourth illustrative embodiment of the invention will be described below.

FIG. 7 is a perspective view illustrating a paper feed tray 20 included in the laser printer 1 constructed according to the fourth illustrative embodiment. FIG. 8 is a view similar to FIG. 7, except that the USB memory device 200 has been attached to the printer 1.

The present embodiment is different from the first embodiment only with respect to elements concerning a position at which a USB socket is mounted on the printer 1, and is common to the first embodiment with respect to the remaining elements. Therefore, the common elements of the present embodiment will be omitted in the description.

The body casing 100 defines a recessed portion (partially-open inner-space) having an opening aperture (not shown) at the front face 100*b* (see FIG. 5) of the body casing 100, for allowing the paper feed tray 20 to be retracted or accommodated in the body casing 100 and to be extracted from the body casing 100 through the opening aperture. The recessed portion of the body casing 100 is shaped to generally approximate a rear portion of the paper feed tray 20 which is to be accommodated in the body casing 100 when the paper feed tray 20 is retracted.

As illustrated in FIG. 7, a USB socket 91*d* is mounted onto the paper feed tray 20, by effective use of the aforementioned recessed portion used for accommodating the paper feed tray 20 situated in a retracted position.

More specifically, the USB socket 91*d* is mounted onto the paper feed tray 20 at a position located rearward of the foremost surface of the front face 20*a* of the paper feed tray 20 (e.g., a rearward-facing surface of the front face 20*a*).

In other words, the USB socket 91*d* is mounted onto the paper feed tray 20 at a position which allows the USB memory device 200 which has been attached to the USB socket 91*d* as illustrated in FIG. 8, when the paper feed tray 20 is retracted in the body casing 100 as illustrated in FIG. 4, to be located inside the printer 1, that is to say, in the free space left in the body casing 100 even when the paper feed tray 20 has been retracted in the body casing 100.

More specifically, as illustrated in FIG. 8, the USB memory device 200, when attached to the USB socket 91*d*, is extended along a longitudinally-extending side face of a tray chassis 20*b* for defining a storage volume for storing paper sheets P, in closely-spaced face-to-face relationship therewith.

Once the paper feed tray 20 is retracted in the body casing 100 with the USB memory device 200 being attached to the USB socket 91*d*, the USB memory device 200 is accommodated within the space created between the outer surface of the paper feed tray 20 and the inner surface of the body casing 100, with no risk of the USB memory device 200 interfering with the paper feed tray 20 and the body casing 100.

As will be evident from the above explanation, the USB memory device 200 which has been attached to the USB socket 91*d*, once the paper feed tray 20 is retracted in the body casing 100, is accommodated inside the printer 1, thereby preventing inadvertent snagging of a user's hands, clothing or other articles on the USB memory device 200 which has been attached to the USB socket 91*d*.

As a result, the USB memory device 200 is prevented from experiencing undesirable disconnection due to user's inadvertent engagement, and also the USB socket 91*d* and the plug 220 of the USB memory device 200 are prevented from being damaged or broken due to user's inadvertent engagement.

In addition, the printer 1 is advantageous in saving space to be occupied by the printer 1, because the USB memory device 200 does not require any additional space.

Moreover, the recessed portion defined within the body casing 100 for storage of the paper feed tray 20 is utilized for accommodating the USB memory device 200, thereby eliminating the necessity of forming in the printer 1 an additional and exclusive recessed-portion for accommodating the USB memory device 200.

Further, when the paper feed tray 20 is extracted forward from the body casing 100, a user can do manual work for attachment and detachment of the USB memory device 200 to and from the USB socket 91*d*, with greater ease.

Still further, when the paper feed tray 20 is retracted in the body casing 100, the USB memory device 200 which has been attached to the USB socket 91*d* is located in a hidden or obscure place, resulting in the enhanced security for the high portability of the USB memory device 200 for transporting data from one location to another.

Fifth Illustrative Embodiment

Figure 10:
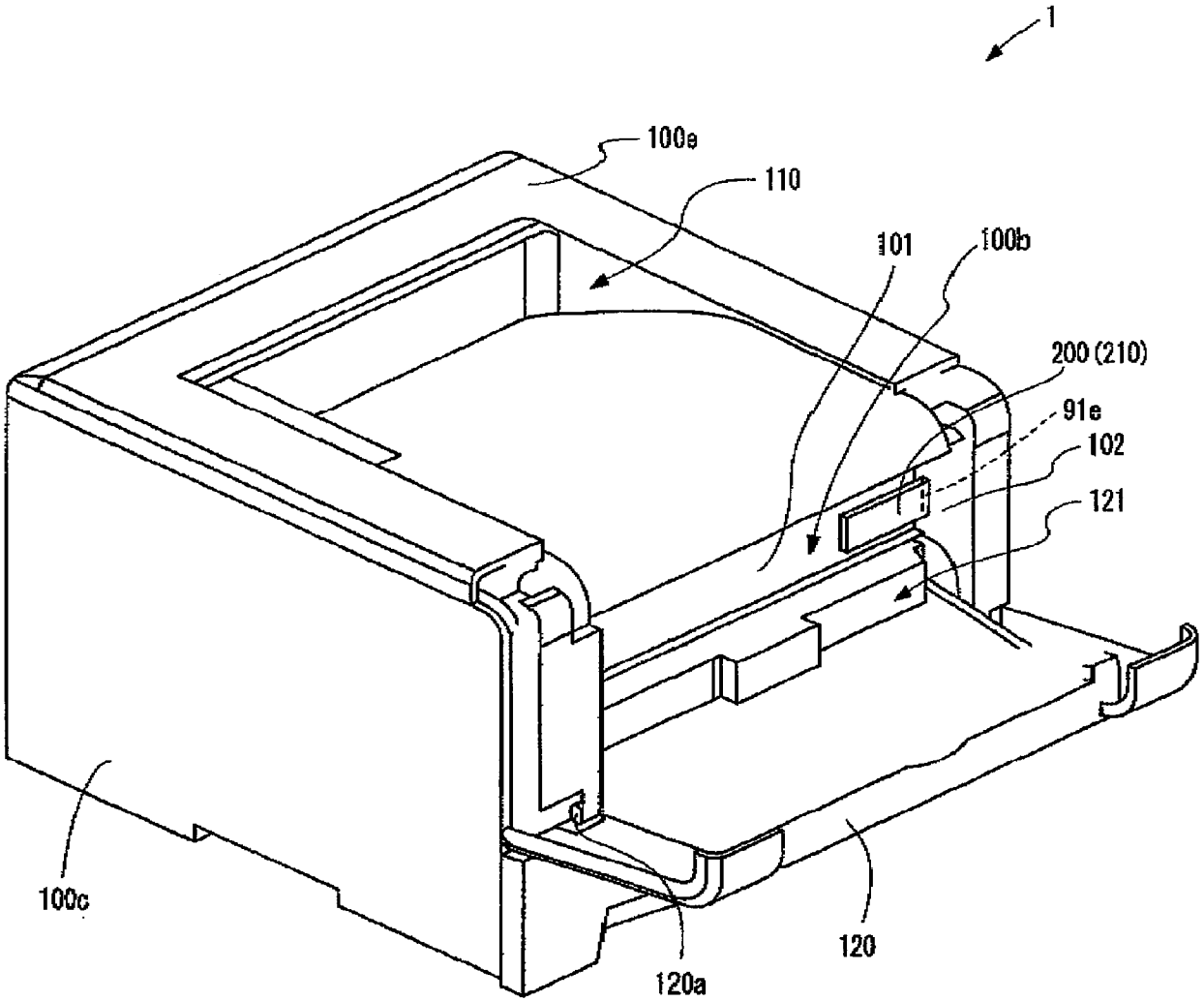
FIG. 10 is a view similar to FIG. 9, except that the USB memory device 200 has been attached to a certain area inside the laser printer 1.

Referring next to FIGS. 9 and 10, a laser printer 1 constructed according to a fifth illustrative embodiment of the present embodiment will be described below.

FIG. 9 is a perspective view illustrating the laser printer 1, with the retractable manual feed tray 120 being unfolded. FIG. 10 is a view similar to FIG. 9, except that the USB memory device 200 has been attached to a certain area inside the printer 1.

The present embodiment is different from the first embodiment only with respect to elements concerning a position at which a USB socket is mounted on the printer 1, and is common to the first embodiment with respect to the remaining elements. Therefore, the common elements of the present embodiment will be omitted in the description.

As illustrated in FIG. 2, an upper portion of the front face 100*b* of the body casing 100 is covered with the manual feed tray 120.

As illustrated in FIG. 9, the manual feed tray 120 is disposed to be pivotable forward about the support shaft 120*a*. The manual feed tray 120 is pivotable between a retracted position (depicted in FIG. 2) and an unfolded position (depicted in FIG. 9). Pivoting the manual feed tray 120 to the unfolded position allows a user to access the manual-feed paper inlet 121 through which a paper sheet P is to be fed.

At a portion of the front face 100*b* of the body casing 100 which is covered with the manual feed tray 120 in the retracted position, a recessed portion is formed which is defined by a wall 101 extending in a lateral direction of the printer 1, two side end walls 102 and 102 positioned in opposite longitudinal ends of the wall 101, etc.

A USB socket 91*e* is mounted onto at least one of the two side walls 102 and 102 both of which are oriented perpendicularly to the wall 101.

As illustrated in FIG. 10, the USB memory device 200, when attached to the USB socket 91*e*, is held in a position allowing the USB memory device 200 to extend along the longitudinally-elongated surface of the wall 101 defined by the front face 100*b* of the body casing 100, in closely-spaced face-to-face relationship with the wall 101.

Once the manual feed tray 120 is retracted in the body casing 100 with the USB memory device 200 being attached to the USB socket 91*e*, the USB memory device 200 is accommodated in the space created among the wall 101, the two side end walls 102 and 102, and a rear face of the manual feed tray 120, without causing the main body 210 of the USB memory device 200 to interfere with the manual feed tray 120.

As will be evident from the above explanation, the USB memory device 200 which has been attached to the USB socket 91*e*, once the manual feed tray 120 is retracted in the body casing 100, is accommodated inside the printer 1, thereby preventing inadvertent snagging of a user's hands, clothing or other articles on the USB memory device 200 which has been attached to the USB socket 91*e*.

As a result, the USB memory device 200 is prevented from experiencing undesirable disconnection due to user's inadvertent engagement, and also the USB socket 91*e* and the plug 220 of the USB memory device 200 are prevented from being damaged or broken due to user's inadvertent engagement.

In addition, the printer 1 is advantageous in saving space to be occupied by the printer 1, because the USB memory device 200 does not require any additional space.

Moreover, the recessed portion defined within the body casing 100 is utilized for accommodating the USB memory device 200, thereby eliminating the necessity of forming in the printer 1 an additional and exclusive recessed-portion for accommodating the USB memory device 200.

Further, when the manual feed tray 120 is pivoted forward from the body casing 100 to the unfolded position, a user can do manual work for attachment and detachment of the USB memory device 200 to and from the USB socket 91*e*, with greater ease.

Still further, when the manual feed tray 120 is retracted in the body casing 100, the USB memory device 200 which has been attached to the USB socket 91*e* is located in a hidden or obscure place, resulting in the enhanced security for the high portability of the USB memory device 200 for transporting data from one location to another.

Exemplary Modified Versions (1) The above-described illustrative embodiments may be practiced such that a USB socket is alternatively or additionally mounted on the rear face of the manual feed tray 120 which is opposed to the front face 100*b* of the body casing 100 when the manual feed tray 120 is retracted.

(2) The above-described illustrative embodiments may be practiced such that a USB socket is alternatively or additionally mounted on the paper-exit wall 72*a* at a position having no risk of interfering with discharge of paper sheets P from the paper outlet 74.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for image formation, comprising:

an imaging device configured to form images on recording media;

a housing defining a front face, a rear face, side faces, a top face and a bottom face, configured to house the imaging device;

a recessed portion configured so as to be openable at selected at least one of the front face, the side faces and the top face of the housing;

an attachment mechanism allowing an external storage device to be attached to the apparatus for electrical connection thereto, the attachment mechanism being in a position allowing the external storage device, when attached to the attachment mechanism, to be accommodated within the recessed portion; and a feed tray configured to feed the recording media to the imaging device, wherein the feed tray is selectively disposed in an open position and a closed position, and when disposed in the closed position, the feed tray occludes the recessed portion.

2. The apparatus according to claim 1, wherein the recessed portion is defined by and on the selected at least one face of the housing, the recessed portion acts as a media exit section configured to have a wall-like structure and an exit tray, the wall-like structure has a media outlet allowing the recording media to exit the media outlet into the exit tray after the imaging device forms images on the recording media, the exit tray is used for storage of the recording media in a stack after the recording media exits the media outlet into the exit tray, and the attachment mechanism is disposed on the wall-like structure at a predetermined distance away from a reference plane of the exit tray, which is larger than a distance between the media outlet and the reference plane of the exit tray.

3. The apparatus according to claim 1, wherein the recessed portion includes a recessed handle defined by and on the selected at least one face of the housing, at least configured to carry the apparatus.

4. The apparatus according to claim 1, further comprising a feed tray configured to feed the recording media to the imaging device, wherein the feed tray is configured to be insertable into and extractable from the housing, the feed tray has a front face defining at least in part the selected at least one face of the housing when the feed tray is inserted in the housing, the recessed portion is defined by and on the front face of the feed tray, and the recessed portion acts as a recessed handle at least configured to extract the feed tray from the housing.

5. The apparatus according to claim 4, wherein the attachment mechanism is disposed at the feed tray.

6. The apparatus according to claim 1, further comprising a feed tray configured to feed the recording media to the imaging device, wherein the feed tray is configured to be insertable into and extractable from the housing, the recessed portion is defined within the housing when the feed tray is inserted in the housing, and the openable member belongs to the feed tray.

7. The apparatus according to claim 6, wherein the attachment mechanism is disposed at the feed tray.

8. The apparatus according to claim 6, wherein the recessed portion includes a recessed handle defined by and on the selected at least one face of the housing, at least configured to extract the feed tray from the housing.

9. The apparatus according to claim 1, wherein the feed tray is pivotably coupled to the housing.

10. The apparatus according to claim 1, wherein the feed tray has a front face and a rear face as viewed when the feed tray is disposed in the closed position, and the recessed portion is defined within the housing when the feed tray is disposed in the closed position.

11. The apparatus according to claim 10, wherein the attachment mechanism is disposed at a predetermined position within the housing, which is located opposing to the rear face of the feed tray disposed in the closed position.

12. The apparatus according to claim 1, wherein the recessed portion is configured to accommodate the external storage device along a longitudinally-elongated surface of a wall defined by the front face of the housing.

* * * * *

UNITED STATES PATENT AND TRADEMARK OFFICE

CERTIFICATE OF CORRECTION

PATENT NO. : 7,961,206 B2
APPLICATION NO. : 11/691648
DATED : June 14, 2011
INVENTOR(S) : Takashi Ohmiya It is certified that error appears in the above-identified patent and that said Letters Patent is hereby corrected as shown below:

Column 20, Claim 6, Lines 7-9:
Please delete "further comprising a feed tray configured to feed the recording media to the imaging devices,"

Column 20, Claim 6, Lines 11-12:
Please delete "the housing, the recessed" and insert --the housing, and the recessed--

Column 20, Claim 6, Lines 13-14:
Please delete "housing, and the openable member belongs to the feed tray" and insert --housing.--

Please delete claims 2, 3, 4, 5 and 8.

Signed and Sealed this
Seventeenth Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,961,206 B2
APPLICATION NO. : 11/691648
DATED : June 14, 2011
INVENTOR(S) : Takashi Ohmiya It is certified that error appears in the above-identified patent and that said Letters Patent is hereby corrected as shown below:

Delete the title page and substitute therefore the attached title page showing the corrected number of claims in patent.

Column 19, Line 30 - Column 20, Line 6:
Delete Claims 2-5.

Column 20, Claim 6, Lines 7-9:
Please delete "further comprising a feed tray configured to feed the recording media to the imaging devices,"

Column 20, Claim 6, Lines 11-12:
Please delete "the housing, the recessed" and insert --the housing, and the recessed--

Column 20, Claim 6, Lines 13-14:
Please delete "housing, and the openable member belongs to the feed tray" and insert --housing.--

Column 20, Lines 17-20:
Delete Claim 8.

This certificate supersedes the Certificate of Correction issued April 17, 2012.

Signed and Sealed this
Nineteenth Day of June, 2012

David J. Kappos

David J. Kappos
*Director of the United States Patent and Trademark Office*

(12) United States Patent
Ohmiya

(10) Patent No.: US 7,961,206 B2
(45) Date of Patent: Jun. 14, 2011

(54) ATTACHMENT FOR USE IN IMAGE-FORMING APPARATUS TO CONNECT EXTERNAL DEVICE THERETO

(75) Inventor: Takashi Ohmiya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1113 days.

(21) Appl. No.: 11/691,648

(22) Filed: Mar. 27, 2007

(65) Prior Publication Data

US 2007/0229570 A1 Oct. 4, 2007

(30) Foreign Application Priority Data

Mar. 31, 2006 (JP) ..... 2006-098168

(51) Int. Cl.

| | |
|---|---|
| ***B41J 29/13*** | (2006.01) |
| ***B41J 2/385*** | (2006.01) |
| ***B41J 2/41*** | (2006.01) |
| ***B41J 2/435*** | (2006.01) |

(52) U.S. Cl. ..... 347/138; 347/108; 347/152; 347/263

(58) Field of Classification Search ..... 347/138, 347/152, 263

See application file for complete search history.

(56) References Cited

U.S. PATENT DOCUMENTS

2002/0127028 A1* 9/2002 Amano ..... 399/88

FOREIGN PATENT DOCUMENTS

| | | |
|---|---|---|
| JP | 7089190 | 4/1995 |
| JP | 2003077606 | 3/2003 |
| JP | 2003276276 | 9/2003 |
| JP | 3100895 U1 | 1/2004 |
| JP | 2004134469 | 4/2004 |
| JP | 2004230737 | 8/2004 |
| JP | 2005-109584 A | 4/2005 |

OTHER PUBLICATIONS

JP Office Action dtd Jul. 7, 2009, JP Appln. 2006-098168, English translation.

JP Office Action dtd Jan. 19, 2010, JP Appln. 2006-098168, partial English translation.

* cited by examiner

*Primary Examiner* — Matthew Luu
*Assistant Examiner* — Kendrick X Liu
(74) *Attorney, Agent, or Firm* — Banner & Witcoff, Ltd.

(57) ABSTRACT

An apparatus for image formation is disclosed which includes an imaging device forming images on record media; a housing defining a front face, a rear face, both side faces, a top face and a bottom face, to thereby house the imaging device; a recessed portion configured so as to be openable at selected at least one of the front face, the both side faces and the top face of the housing; and an attachment mechanism allowing a data-storable external storage device to be attached to the apparatus for electrical connection thereto, the attachment mechanism being in a position allowing the external storage device, when attached to the attachment mechanism, to be accommodated within the recessed portion.

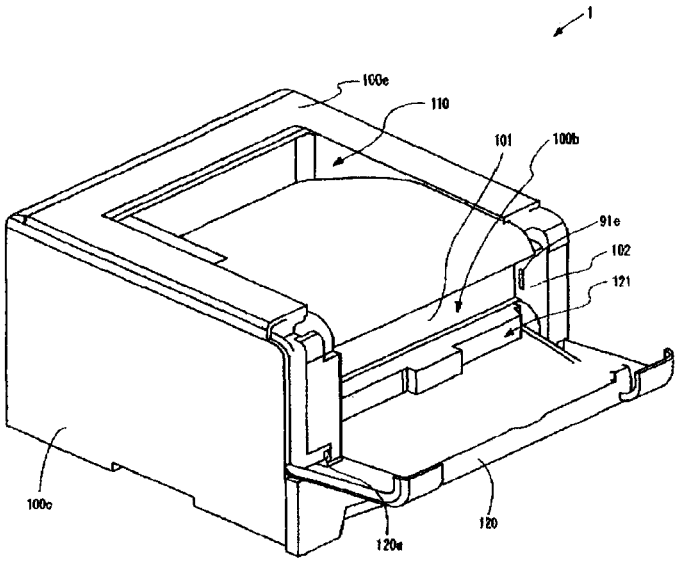

7 Claims, 11 Drawing Sheets